United States Patent [19]

Ezoe

[11] Patent Number: 4,758,116

[45] Date of Patent: Jul. 19, 1988

[54] MULTI-BLADE DITCHING MACHINE

[76] Inventor: Takuji Ezoe, 2-7-14 Tsukushino, Machida-shi, Tokyo, Japan

[21] Appl. No.: 918,198

[22] Filed: Oct. 14, 1986

[30] Foreign Application Priority Data

May 23, 1986 [JP] Japan ..... 61-117436

[51] Int. Cl.[4] ..... E02F 5/02

[52] U.S. Cl. ..... 405/164; 37/54; 37/98; 405/159

[58] Field of Search ..... 37/98, 54, 193; 405/164, 159, 180, 183

[56] References Cited

U.S. PATENT DOCUMENTS 4,053,998 10/1977 Ezoe ..... 37/98
4,312,144 1/1982 Ezoe ..... 37/98

FOREIGN PATENT DOCUMENTS 0013685 2/1977 Japan ..... 405/164
57-23051 5/1982 Japan .
2027771 2/1980 United Kingdom ..... 37/98
734352 5/1980 U.S.S.R. ..... 37/98

*Primary Examiner*—Clifford D. Crowder
*Attorney, Agent, or Firm*—Armstrong, Nikaido, Marmelstein & Kubovcik

[57] ABSTRACT

A ditching machine for digging a ditch or a trench for submarine cables having at least several pairs of blades disposed along the longitudinal direction of the center body of the machine. At least the blades in the forward position have a ditching portion which ditches soil, and a soil-pushing portion which pushes the soil thus ditched away in a direction lateral to the moving direction of the ditching machine. The soil-pushing portion is at the top of the ditching portion and has a wider horizontal width as seen from front of the ditching machine than that of the ditching portion when the ditching machine is in a normal operation position. Further, the tapering angle at the bottom of the center body being in the range between 10° and 17° and the towing tension of the towing wire between the ditching machine and the work ship is considerably reduced.

3 Claims, 5 Drawing Sheets

MULTI-BLADE DITCHING MACHINE

BACKGROUND OF THE INVENTION

The present invention relates to improvements in a multi-blade ditching machine for use in burying submarine cables and the like under the sea floor or lifting them up for repairing.

To protect submarine cables or the like from fishing tools, it has been the practice in many countries of the world to bury a cable and the like in the sea floor and to pull them out for repairing when faults are detected in them. For this purpose, ditching machines which ditch the soil and/or sediment of the sea floor to a desired depth have been used and such ditching machines are called cable-buriers or cable-searchers depending on the purpose thereof.

Although the structure of a cable-burier is somewhat different from that of a cable-searcher due to the difference in their purposes, the essential ditching portions of both kinds of machine are similar to each other, and water jets or plows are used for ditching trenches on the sea floor. When it comes to the plow ditching portions, two types have been used, i.e., a single-blade type ditching portion and a multi-blade type ditching portion.

A ditching machine (or a cable-burier) with the multi-blade type ditching portion is described in U.S. Pat. No. 4,312,144, and Japanese Pat. No. 1130568. FIG. 4 is side elevation view of the latter multi-blade ditching machine illustrating its structure. FIG. 5 is a view taken along the line B—B of the multi-blade ditching machine shown in FIG. 4. In FIGS. 4 and 5, the reference numeral 1 stands for a stabilizing wing, 2 stands for a ditching portion, 3 stands for a center leading body, 3*a* stands for its main body, 3*b* stands for its wedge portion, 4 stands for a joint connecting the stabilizing wing to the ditching portion, $5_1$ through $5_7$ stand for ditching blades and soil-pushing blades. In this embodiment, there are 7 blades in the ditching portion. (i.e.,n=7)

The multi-blade ditching machine has a stabilizing wing 1 at its front position which provides the machine stability in the horizontal plane, to which the ditching portion 2, which ditches a trench on the sea floor, is connected by joint 4 which makes the ditching portion moveable only in the vertical plane.

To lead a cable and/or a repeater in the bottom of a trench thus excavated, the ditching portion 2 has a center leading body 3 at its center back position which serves as a passage for leading them.

The structure of the ditching portion 2 is composed in such a way that the more forwardly positioned ditching blade have a wider blades width and smaller blade depth, and the depth from the sea floor to a ditching blade gradually increases as its position moves in the rear direction. Thus, ditching blades $5_1$ through $5_7$, are disposed along the lower side of center body 3.

On the upper side of each of the ditching blades $5_1$ through $5_7$, a soil-pushing blade is disposed for pushing the excavated soil and/or sand outwardly and both edges of the soil-pushing blade are cut slant-wise so that they open upwardly. Each soil-pushing blade of the forward blades ($5_1$ through $5_4$) pushes the excavated soil and/or sand away over the sea floor, and each soil-pushing blade of the rear blades ($5_5$ through $5_7$) pushes the excavated soil and/or sand away from the ditch just dug. As an example, consider the sixth blade (which is a rear blade). In pushing away the soil and/or sand excavated by the sixth blade $5_6$, the inverse trapezoid shaped space created by passing of the preceding blade, i.e., blade $5_5$(see FIG. 5) is utilized as its passage along the flow of it. (this will be called a sand-pushing passage.) Said slantings of a soil-pushing blade (that is, the shape of an inverse trapezoid) prevent the excavated soil and/or sand from falling into the trench just ditched, and serve to reduce the towing force of the ditching machine.

Generally speaking, when the sea floor is composed of sand, the ditching resistance of a ditching blade is proportional to the square of the ditching depth of the blade. Therefore, the ditching resistance of a multi-blade ditching machine which repeats shallow ditchings to a desired depth can be reduced by a factor one-sixth as compared with that of a single-blade ditching machine.

As the ditching resistance of a multi-blade ditching machine is very small, a little amount of soil-pushing resistance which might be negligible in case of a single-blade ditching machine brings about a problem from a view point of reducing the total towing resistance of the machine further.

It is true in common to all sorts of ditching machines that the existence of the center body 3 whose width is relatively wide for leading repeaters and the like makes the soil-pushing resistance large.

On one hand, this soil-pushing resistance enhances the towing resistance of the machine, and on the other it provides an undesireable cause to make the ditching depth of the machine smaller by pushing up the center body's lower side 3*b*.

Therefore, to make the flow of the pushed-away soil as smooth as possible, the center body has a wedge portion on its lower side, being constructed by two tapering planes on right and left, each of which makes an angle of 45° with respect to the vertical plane, i.e., the vertex of the wedge is 90°. (see FIG. 3 and FIG. 5)

A cable ship or work ship tows said multi-blade ditching machine through a towing wire (not shown in the figures) that is connected to the head part of the stabilizing wing and the sea floor is ditched as a result.

The submarine cables and repeaters drawn out from the work ship are led to the ditch bottom by way of the center body 3 and are pushed to the ditch bottom by the weight of the pushing roller 6. The pushing roller 6 is moveable along the guide 8. The reference numeral 7 stands for a frame that is rotatable around a pivot located at the other end of the pushing roller. A caster, denoted by 9, is disposed for ease of carrying the machine on a work ship, decending it into the sea floor, and refloating it from the sea floor.

A multi-blade ditching machine of the structure mentioned above, however, has the following problems.

As shown in FIG. 5, the space of the sand-pushing passage of the sixth blade is limited by the reverse side of the fifth blade $5_5$ and the surface of the sixth blade $5_6$ for its up-and-down boundaries, and for its right-and-left boundaries, as they are symmetrical with respect to the vertical plane at center, consider as an example the left-half space. The leftmost boundary is the side wall of sand whose surface is slanted by an angle of 15° (if cut by a plane perpendicular to the moving direction, this is 16°) with respect to the vertical plane, and on the right-hand side where the center body exists, the tapering surface 3*b* of the wedge portion which is slanted by an angle 45° with respect to the vertical plane limits the half space.

As to the opposed two planes limiting the up-and-down boundaries of the space, care has been taken in the design so that the pushed-away soil and/or sand does not touch the reverse side of the preceding blade, i. e., blade $5_5$ by choosing an appropriate distance between the fifth blade $5_5$ and the sixth blade $5_6$.

Meanwhile, as to the opposed two planes of the right-and-left boundaries, i.e., the surface of the side wall of sand and the tapering surface *3b* of the wedge portion of the center body the difference between their slanted angles with respect to the vertical plane is as large as $15°-45°=-30°$ (where the negative sign means "tapering off") and so the space functions as a sand-pushing passage of "tapering off" to the pushed-away soil rising along the blade.

In particular, when the sea floor is composed of sand, the flow of the excavated sand passing through this sort of a "tapering off" sand-pushing passage tends to be clogged, and this causes the soil-pushing resistance to increase remarkablly. At the same time, the upward-directed force component due to the flow reduces the ditching depth unreasonablly by pushing up the tail part of the ditching portion 2.

Therefore, in designing a ditching machine or the like, care should be taken to avoid the "tapering off" by paying due attention to the up-and-down, right-and-left boundaries of a cross section of the passage. In particular, when the sea floor is composed of sand, because the characteristic of sand in such a flow is entirely different from that of soil or clay, and it is in the field of gravity, the most effective way to overcome the obstruction of a sand-pushing passage is to avoid the "tapering off" of the right-and-left boundaries of a cross section of the passage. (the tapering off of a sand-pushing passage will mainly mean that of the length between the right-and-left boundaries of a cross section.)

SUMMARY OF THE INVENTION

It is an object of the present invention to provide a new and improved multi-blade ditching machine by overcoming the disadvantages and limitations of a prior ditching machine.

It is also an object of the present invention to provide a multi-blade ditching machine which reduces the towing resistance of the machine, and also, to enhance the ditching depth of the machine.

Another object of the present invention is to increase the pushing effect of a pushing roller by disposing a passage for exclusive use in leading thin cables along the interior space of a wedge portion.

The above and other objects are attained by a multi-blade ditching machine comprising; a stabilizing wing; an elongated hollow center body movably connected to said stabilizing wing; said center body being movable in the vertical direction with respact to said stabilizing wing; a plurality of blades disposed along said center body at predetermined intervals; the blades which are positioned at the rear portion of said ditching machine having a greater vertical length and smaller horizontal extent transverse to the direction of movement than the more forwardly disposed blades and adapted to ditch more deeply with narrower ditching widths; at least the two most forward of the blades having a ditching means for ditching soil and a soil-pushing means for pushing said soil substantially horizontally in a direction transverse to the moving directin of the ditching machine; the soil-pushing means being at the top of said ditching means and having a wider horizontal width as seen from front of the ditching machine than that of said dtiching means when the ditching machine is in a normal operating position; and said center body having wedge portion disposed on its bottom, the tapering angle of the wedge portion being selected so that a sand pushing passage defined by slanted planes provided by rear blades and tapered plane by said wedge portion spreads out along flow of pushed-out soil.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
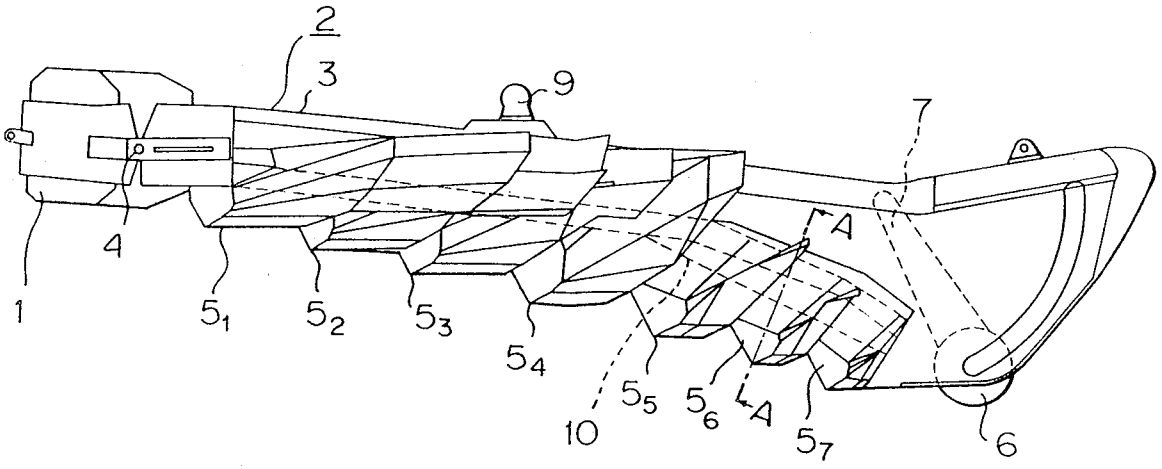
FIG. 1 is a side elevation view of a multi-blade ditching machine according to the present invention, and illustrating its structure.
Figure 2:
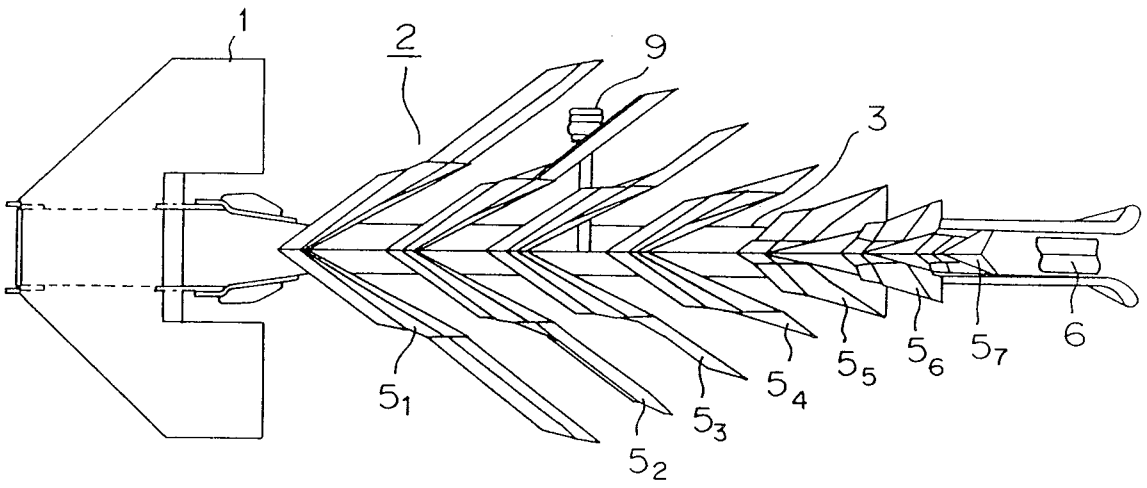
FIG. 2 is a plan view of the multi-blade ditching machine shown in FIG. 1.

FIG. 1 is a side elevation view of a multi-blade ditching machine of the invention derived from the conventional one by adding a wedge portion with an acute vertex angle on the lower side of the center body in the neighbourhood of the rear blades (the rear blades mean the fifth, sixth and seventh blades, the term will be used in this sense). FIG. 2 is a plan view of the machine.

Figure 3:
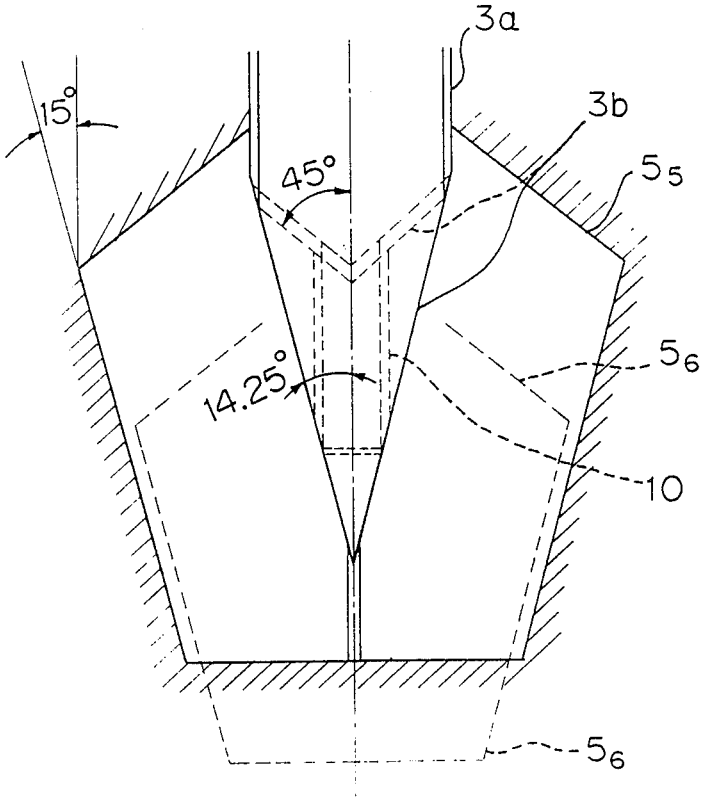
FIG. 3 is a view taken along A—A; of the multi-blade ditching machine shown in FIG. 1

FIG. 3 is a cross section cut at, as an example, the sixth blade position in perpendicular to the center body for a clear illustration of the invention. It shows the relationship between the border lines of the center body, wedge portion, and those of the surrounding soil (which are in accordance with the contour of the fifth blade). At the same time, it shows in dotted lines, the sixth ditching blade, soil-pushing blade, and its ceiling plate, moreover, the conventional wedge portion with a vertex angle of 90° and a passage for exclusive use in leading thin cables of the invention disposed in the interior space of said wedge portion.

Figure 4:
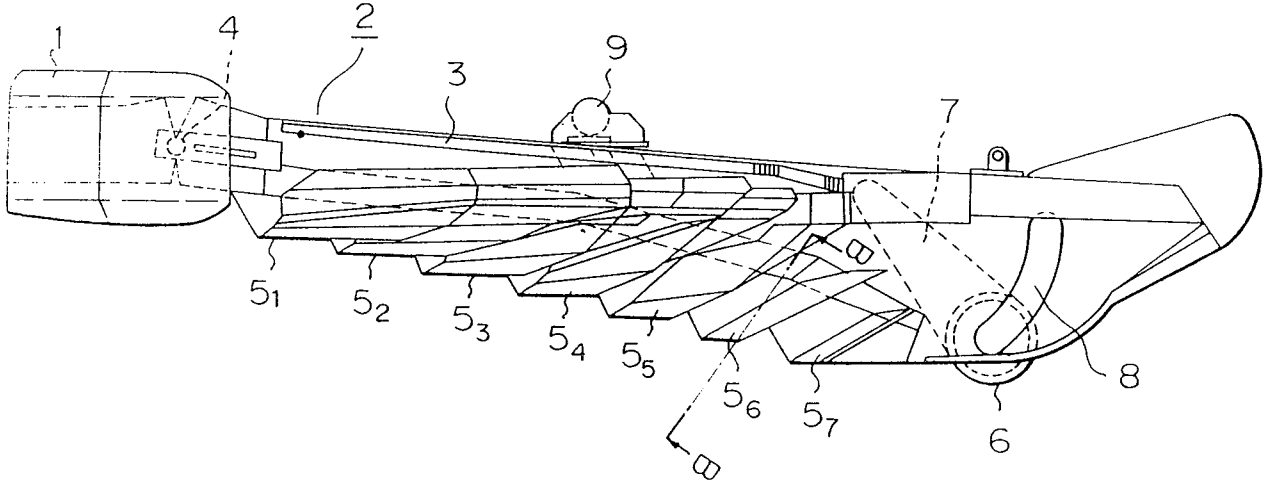
FIG. 4 is a side elevation of a conventional multi-blade ditching machine.
Figure 5:
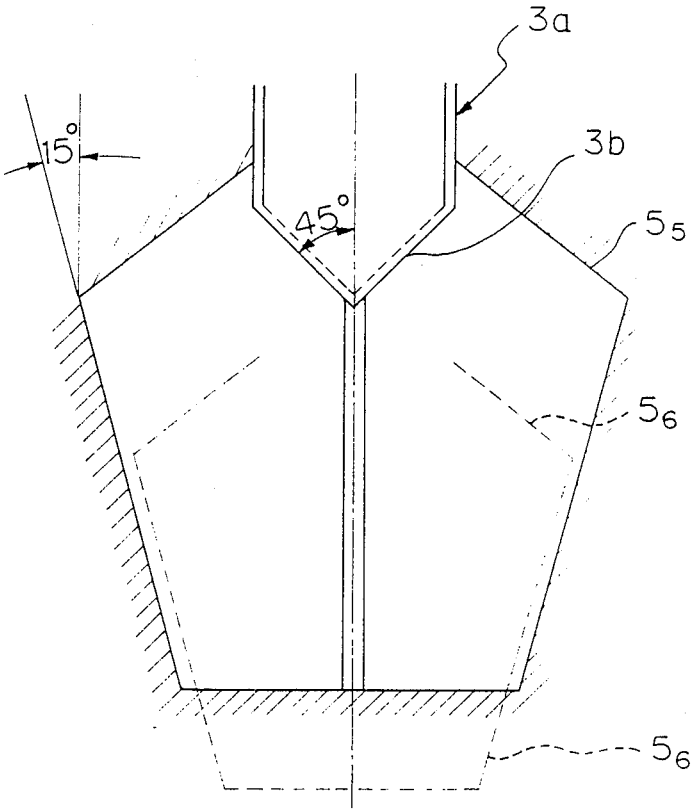
FIG. 5 is a view taken along line B—B of the multi-blade ditching machine shown in FIG. 4.

A reference numeral being equal to that in FIG. 4, where the conventional multi-blade ditching machine is shown, is used in FIGS. 1-3 so far as they stand for the same machine composing element.

First, when the side walls made by each of the rear blades are slanted by an angle of 16° to the vertical plane, we shall explain in detail how to design the acute vertex angle of the wedge portion *3b* disposed at the bottom or lower side of the center body in order to make each blade's sand-pushing passage spread out along the flow path of pushed-out soil.

If the center body 3 is horizontal at each position of the rear blades, as the side walls of sand are slanted by an angle of 16° with respect to the vertical plane, the condition for any sand-pushing passage to spread out can be always satisfied by choosing an angle less than 16° for each slanted angle of the opposed planes of the wedge portion *3b* with respect to the vertical plane, in no matter what angle the pushed-out soil rises.

Actually, however, for leading what is to be buried to the bottom of the ditch thus excavated, each of the rear blades of the center body 3 is slanted downward. The center body 3 near the position of the sixth blade of this embodiment is slanted downward by an angle of 20° to the horizontal plane, therefore, depending on the rising angle of the soil being pushed out, a noticeable difference is required in the correction of the slanted angles of the opposed planes, as shown in Table 1 which will be described later.

Another point to be noted in this multi-blade ditching machine is that when the widths of the fifth blade and the sixth blade are compared in the horizontal position at any height of both blades, the width of the fifth blade is wider by 2 cm for each of both sides (for a U figure shaped cross section of the excavated ditch, the smaller the gap the better, and despite the fact the machine has the 2 cm gap to satisfy the condition that at a ditching depth somewhat deeper than the designed value of 110 cm, the width of the preceding blade should be wider. In this example, it becomes zero at a ditching depth of 160 cm.), therefore, a major part of the soil excavated by the sixth blade $5_6$ is pushed away over the ceiling plate and the rest is bypassed sidewise through the 2 cm-gaps created by the blade width difference.

In this embodiment, the left-half cross section ditched by the sixth blade $5_6$ is a trapezoid whose lower side, upper side and height are 21 cm, 26 cm, and 17 cm respectively. Therefore, its area is calculated as follows.

$$(21+26)\times 17/2=400\ (\mathrm{cm}^2)$$

If all the soil excavated by the blade $5_6$ is pushed away through said gaps of 2 cm due to the blade width difference, the height required for the pushed-out soil is 400/2=200(cm) and the ratio of the upper side of the ditching blade $5_6$, i.e., the lower side of the soil-pushing blade $5_6$ (=26 cm) to this height (=200 cm) is put equal to tan $\theta$. Then $\theta=\tan^{-1} 26/200=7.5°$ can be regarded as an angle to make the sand-pushing passage of vertically rising pushed soil more spreading.

Therefore, practically, the effect of the existance of said 2 cm-gap is equivalent to increase the slanted angle of 16° of the side wall further by 7.5° outwardly.

The vertex angle of the wedge portion 3*b* of the center body is supposed to be 28.5°. And consider cases where the soil ditched by the sixth blade $5_6$ is pushed away rising in various angles with respect to the vertical plane (i.e., 0°, 20°, 45°, 60°). Then, in order to ascertain the existence of a spreading-out angle of the sand-pushing passage in each case, calculate the angles made by the vertical plane and the soil-pushing directions on the side wall plane and the tapering plane of the wedge portion of the center body respectively, and compare the angle due to said gap effect.

When a line is drawn on a slanted plane with an angle $\theta$ to the horizontal plane slantwise to the plane's direction of inclination so that the projection of the line and that of the direction of inclination make an angle $\phi°$ on the horizontal plane, the angle of inclination of the line $\theta_\phi°$ is obtained by the formula of $$\theta_{100}=\tan^{-1}(\cos\phi\times\tan\theta).$$

In the first place, suppose the pushed-out soil is rising in an angle of 45° with respect to the vertical plane. Then, by definition, the angle denoted by $\phi$ for the side wall plane is also 45°, but as explained earlier, the center body 3 is slanted by an angle of 20° in tail-down, the angle $\phi$ for the tapering plane of the wedge portion of the center leading body should be given as follows.

$$\phi°=45°-20°=25°$$

As for the angle defined by $\theta$, 16° of the side wall plane and 7.5° of the gap (=2 cm) ef fect have been obtained. For the $\theta$ of the wedge tapering plane, half of the vertex angle (=28.5°), that is, 14.25° is used. Thus, $\theta_{45}$, $\theta_{25}$ of the soil-pushing directions on each of the opposed planes are calculated respectively.

In cases where the soil-pushing direction in angles of 0°, 20°, or 60°, the desired angles are calculated in the quite same way. The results thus obtained are summarized in Table 1.

As is seen from Table 1, in this embodiment, the vertex angle of the wedge portion disposed in the lower side of the center body is preferablly given by a value less than 28.5°(14,25×2). The taper angle in the table 1 is possible between 11° and 14.25°, and it is also possible when the tapering angle is between 10° and 17°.

TABLE 1

| Rising angle of the soil-pushing direction to the vertical plane | Angle of the soil-pushing direction along the wedge tapering plane to the vertical plane | Angle of the soil-pushing direction along the side wall plane to the vertical plane | Angle due to the gap effect | Angle of spreading-out for the soil-pushing passage |
|---|---|---|---|---|
| 0° | −13.5° | 16.0° | 7.5° | 10.0° |
| 20° | −14.25° | 15.0° | 7.0° | 7.7° |
| 45° | −13.1° | 11.4° | 5.4° | 3.7° |
| 60° | −11.0° | 8.0° | 3.75° | 0.8° |

(The negative sign represents "tapering off")

When oute diameters of what are to be buried are remarkably different from each other, such as submarine cables with repeaters and the like, a ditching machine to be used for them is designed so that its center body may have a width enough to lead repeaters.

Meanwhile, for lightening of the machine's weight, the design will shorten the total length of the machine and reduce the areas of both tail side plates that protect the pushing roller 6. And in order to reduce the resistance of friction due to it, the pushing roller 6 is disposed as near as possible to the tail end of the center body 3. From a view point of the pushing effect of the pushing roller, an angle between the circumscribed line drawn from the tail end position of the center body about the pushing roller 6 and the horizontal line (which will be termed an incident angle to the roller) is the smaller, the better. In this view point, the pushing roller should be disposed apart from the tail end position of the center body.

Generally, it is recognized as true that said pushing effect is inversely proportional to the value of an incident angle (exactly speaking, its sine). that means, for example, if the incident angle decreases from 45° to 22.5°, the weight of the pushing roller can be reduced by half for the same cable tension.

The conventional ditching machine has the abovementione technical contradiction in its structure.

In this embodiment of the invention, this is solved by utilizing the interior space of the wedge portion with an acute vertex angle for separating leading passages. As shown in FIG. 3 in dotted lines, a vertically-thin rectangular passage 10 his disposed in it for exclusive use of leading cables. That is, a cable is led through this lower passage an the incident angle for it gets smaller. Therefore, the pushing roller can be disposed as forwardly as possible within a permitted value of the pushing effect.

As explained in detail, according to the invention, for any of various ditching machines with different conditions, and appropriate vertex angle for its wedge portion is chosen so that each blade's sand-pushing passage composed of right-and-left opposed parts diverges outwardly along the flow of pushed-out soil, and in this way the towing resistance of the machine is reduced. At the same time, the structure enhances the ditching depth of the machine.

The conventional 7-blade ditching machine has its maximum buring depth of 60 cm in the sea bottom of sand, while the invention's 7-blade ditching machine has its maximum burying depth of 110 cm for the same condition, that is, nearly twice as much.

So far, expected protection realized by the conventional ditching machine is against towing nets or anchors of small fishing boats, and the invention will broaden the possible protection range to a great extent. For example, protection against special sorts of anchors for use in fishing, or anchors of large sized ships of 10,000 through 20,000 tons can be possible.

Generally speaking, average expense of repairing a submarine cable buried in the sea bottom costs more than 100 million yen. By means of using a ditching machine according to the invention, it will be possible to have no fault of a buried submarine cable during the cable's life time depending on the condition of the sea bottom. Therefore, the conventional armoring structure with iron wire for protecting submarine cables, which costs more than 2 million yen per kilo meter is safely omitted. These facts are great economic merits of the invention.

From the foregoing it will now be apparent that a new and improved ditching machine has been found. It should be understood of course that the embodiments dislcosed are merely illustrative and are not intended to limit the scope of the invention. Reference should be made to the appended claims, therefore, rather than the specification as indicating the scope of the invention.

What is claimed is:

1. A multi-blade ditching machine comprising;

a stabilizing wing, an elongated hollow center body movably connected to said stabilizing wing, said center body being movable in the vertical direction with respect to said stabilizing wing, a plurality of blades disposed along said center body at predetermined intervals, the blades which are positioned at the rear portion of said ditching machine having a greater vertical length and smaller horizontal extent transverse to the direction of movement and being adapted to ditch more deeply with narrower ditching widths than the blades disposed at the forward portion of said ditching machine, at least the two most forward of the blades having a ditching means for ditching soil and a soil-pushing means for pushing said soil substantially horizontally in a direction transverse to the moving direction of the ditching machine, each soil-pushing means being at the top of the respective said ditching means and having a wider horizontal width than that of said respective ditching means as seen from the front of the ditching machine a plurality of sand pushing passages defined between slanted planes provided by said blades positioned at the rear portion of said ditching machine and the bottom of said center body, the bottom of said center body being in the form of a wedge and the taper angle of said wedge being selected so that said sand pushing passages diverge outwardly along the flow-path of pushed-out sand.

2. A multi-blade ditching machine according to claim 1, wherein said taper angle is between 10° and 17°.

3. A multi-blade ditching machine according to claim 1, wherein said center body has first and second vertically aligned, longitudinally extending passages internal of the wedge portion, said first passage is large enough to pass a repeater, said second passage is located under the first passage and is capable of passing a cable but unable to pass a repeater.

* * * * *

UNITED STATES PATENT AND TRADEMARK OFFICE

CERTIFICATE OF CORRECTION

PATENT NO. : 4,758,116

DATED : July 19, 1988

INVENTOR(S) : Takuji EZOE

It is certified that error appears in the above-identified patent and that said Letters Patent is hereby corrected as shown below:

Column 3, line 55, "respact" should read --respect--.

Column 5, line 62, "$\theta_{100}$" should read --$\theta_{\emptyset}$--.

Column 6, line 36, "oute diameter" should read --outer diameter--;

line 68, "passage 10 his disposed" should read --passage 10 is disposed--.

Column 7, line 2, "passage an the incident" should read --passage and the incident--.

Signed and Sealed this

Twenty-seventh Day of December, 1988

*Attest:*

DONALD J. QUIGG

*Attesting Officer*

*Commissioner of Patents and Trademarks*